US006155080A

United States Patent [19]

Yamaguchi et al.

[11] Patent Number: 6,155,080

[45] Date of Patent: Dec. 5, 2000

[54] APPARATUS FOR ARRANGING KNITTING NEEDLES

[75] Inventors: Takeshi Yamaguchi, Osaka; Norio Nakamura, Kaga, both of Japan

[73] Assignee: Teijin Limited, Japan

[21] Appl. No.: 09/319,183

[22] PCT Filed: Oct. 6, 1998

[86] PCT No.: PCT/JP98/04513

§ 371 Date: Jun. 2, 1999

§ 102(e) Date: Jun. 2, 1999

[87] PCT Pub. No.: WO99/18276

PCT Pub. Date: Apr. 15, 1999

[30] Foreign Application Priority Data

Oct. 7, 1997 [JP] Japan ..... 9-274625

[51] Int. Cl.[7] ..... D04B 37/00

[52] U.S. Cl. ..... 66/1 R; 66/116

[58] Field of Search ..... 66/1 R, 1 A, 116, 66/114, 115; 26/1

[56] References Cited

FOREIGN PATENT DOCUMENTS 5274059 6/1977 Japan ..... 66/1 R 23492 1/1990 Japan ..... 66/1 R 9256253 9/1997 Japan ..... 66/1 R

*Primary Examiner*—Danny Worrell

*Attorney, Agent, or Firm*—Rader, Fishman & Grauer

[57] ABSTRACT

Inserting knitting needles into a knitting machine in regular order, without requiring experience of the worker, is enabled by the use of a knitting needle arranging apparatus which is comprising:

(a) a series of knitting needle supplying means for sequentially pushing one or plural knitting needles in one direction;

(b) knitting needle stacking means for sequentially stacking and holding the pushed knitting needles in the thickness direction of the knitting needle in cooperation with each of the series of the knitting needle supplying means; and (c) means for moving the knitting needle stacking means from a cooperation state with one of the knitting needle supplying means so as to cooperate with predetermined knitting needle supplying means.

15 Claims, 8 Drawing Sheets

APPARATUS FOR ARRANGING KNITTING NEEDLES

TECHNICAL FIELD

The present invention relates to a knitting needle arranging apparatus and, more particularly, a knitting needle arranging apparatus comprising a series of knitting needle supplying means and knitting needle stacking means for sequentially stacking and holding knitting needles which are pushed from the knitting needle supplying means in the thickness direction of the knitting needle in cooperation with each of the series of the knitting needle supplying means.

BACKGROUND ART

In a circular knitting machine, when knitting needles are inserted into a needle bed in a state where no knitting needles are installed in needle bed (such as the case of replacing the needle bed), the knitting needles of different butt shapes have to be inserted in regular order.

Hitherto, the work has been done manually by an experienced person. For example, in case of inserting needles of the total number of 3,000 or the like which are classified into four kinds (for example, A, B, C, and D) according to the shapes of the butts or the like, the first needles A are inserted into grooves for knitting needles for the whole circumference intermittently at the ratio of one knitting needle to four shuttle grooves. Second needles B, third needles C, and fourth needles D are inserted in a manner similar to the first needles A to thereby insert all of the 3,000 needles.

Usually, grooves for holing few tens of knitting needles per inch are formed in the shuttle of the circular knitting machine. The number of grooves per inch is often about 14 to 36. At the time of the above-mentioned work, therefore, the knitting needles have to be inserted into the grooves formed with a very small pitch at predetermined intervals in order of the knitting needles. Even for the experienced person, the work is very laborious and, moreover, inefficient.

DISCLOSURE OF THE INVENTION

It is an object of the invention to provide a knitting needle arranging apparatus which enables knitting needles to be inserted into a knitting machine in regular order without requiring experience of the worker.

After the wholehearted examinations by the inventors to achieve the object, the inventors have found that the problem can be solved by employing a method of arranging knitting needles in the order of insertion and simply successively inserting the arranged knitting needles into grooves in place of a conventional method of inserting the knitting needles in accordance with a predetermined order at predetermined intervals by the worker, and reached the present invention.

Specifically, according to the invention, the followings are provided.

(1) a knitting needle arranging apparatus comprising:

(a) a series of knitting needle supplying means for sequentially pushing one or plural knitting needles in one direction;

(b) knitting needle stacking means for sequentially stacking and holding the pushed knitting needles in the radial direction of the knitting needle in cooperation with each of the series of the knitting needle supplying means; and (c) means for moving the knitting needle stacking means from a cooperation state with one of the knitting needle supplying means so as to cooperate with predetermined knitting needle supplying means, (2) a knitting needle arranging apparatus according to (1), wherein the knitting needle supplying means comprises:

(d) a knitting needle storing box for stacking and storing a plurality of knitting needles in the radial direction of the knitting needle, which has an opening part from which the stacked knitting needles can pass at the lower end;

(e) a seating installed below the opening part of the knitting needle storing box so as to have a clearance corresponding to the total thickness of one or plural knitting needles with the opening part; and (f) a slider which slides on the seating so as to freely enter the clearance, for sequentially pushing one or plural knitting needles existing in the clearance along the width direction of the knitting needle, and (3) a knitting needle arranging apparatus according to (1) or (2), wherein the knitting needle stacking means is a knitting needle stacking box comprising:

(g) an opening part which is provided in the upper part of the knitting needle stacking box and from which the pushed knitting needles are sequentially inserted along the radial direction of the knitting needle;

(h) a pair of holding guides provided in the upper part of the knitting needle stacking box, for sandwiching the knitting needle inserted from the opening part in a state where the knitting needle is inclined upward in the insertion direction of the knitting needle; and (i) a guide clearance adjusting mechanism for sequentially stacking and sandwiching the inclined knitting needles in the thickness direction of the knitting needle between the pair of holding guides.

BEST MODE FOR CARRYING OUT THE INVENTION

Figure 1:
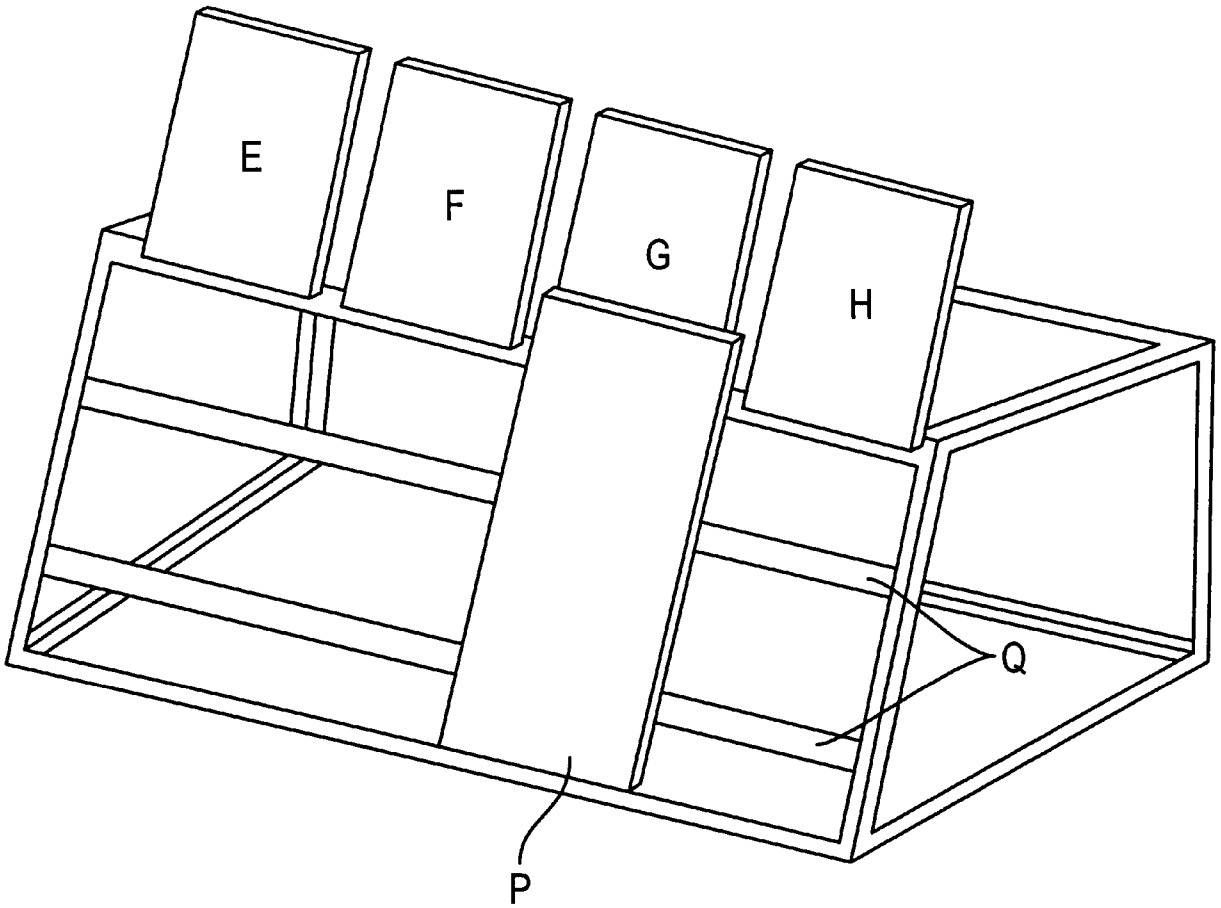
FIG. 1 is a schematic diagram for depicting an example of a knitting needle arranging apparatus of the invention.

The invention will be described with reference to the drawings. The invention, however, is not limited to the mode shown in the drawings.

FIG. 1 schematically shows an example of a knitting needle arranging apparatus of the invention, in which E, F, G and H denote knitting needle supplying means and P represents knitting needle stacking means. The knitting needle stacking means P can move on slide rails Q and sequentially stack and hold knitting needles pushed from predetermined knitting needle supplying means in the knitting needle radial direction.

For example, in case of inserting the needles of the four kinds A, B, C, D by turns, first, the first needles A are stored in the knitting needle storing box of the knitting needle supplying means E. Then, the second needles B are stored in the knitting needle storing box of the knitting needle supplying means F. The third needles C and the fourth needles D are similarly stored in the knitting needle storing boxes of the knitting needle supplying means G and H respectively.

The knitting needle stacking means P is moved to positions where the knitting needles pushed from the knitting needle supplying means E to H can be stacked and held and the knitting needles pushed from the respective knitting needle supplying means are sequentially stacked and held in the knitting needle radial direction. Consequently, the knitting needles are stacked in the knitting needle holding box of the knitting needle stacking means P in the order of A, B, C, D, . . . , .

Therefore, only by simply taking out the knitting needles arranged in the knitting needle holding box and inserting the knitting needles successively into the needle bed by the worker, the inserting work is completed. When the work of taking the knitting needles arranged in the knitting needle holding box and inserting them into the shuttle is performed by a robot, the knitting needle inserting work can be fully automated.

It is sufficient to move the knitting needle stacking means P by using conventionally known control means. For instance, by executing a control according to a computer program, even in the case of complicated arrangement of knitting needles, the knitting needle stacking means P can be easily controlled.

As knitting needle supplying means which can be suitably used for the knitting needle arranging apparatus of the invention, knitting needle supplying means comprising the following elements (d) to (f) is shown as an example:

(d) a knitting needle storing box for stacking and storing a plurality of knitting needles in the radial direction of the knitting needle, which has an opening part from which the stacked knitting needles can pass at the lower end;

(e) a seating installed below the opening part of the knitting needle storing box so as to have a clearance corresponding to the total thickness of one or plural knitting needles with the opening part; and (f) a slider which slides on the seating so as to freely enter the clearance, for sequentially pushing one or plural knitting needles existing in the clearance along the radial direction of the knitting needle.

Figure 2:
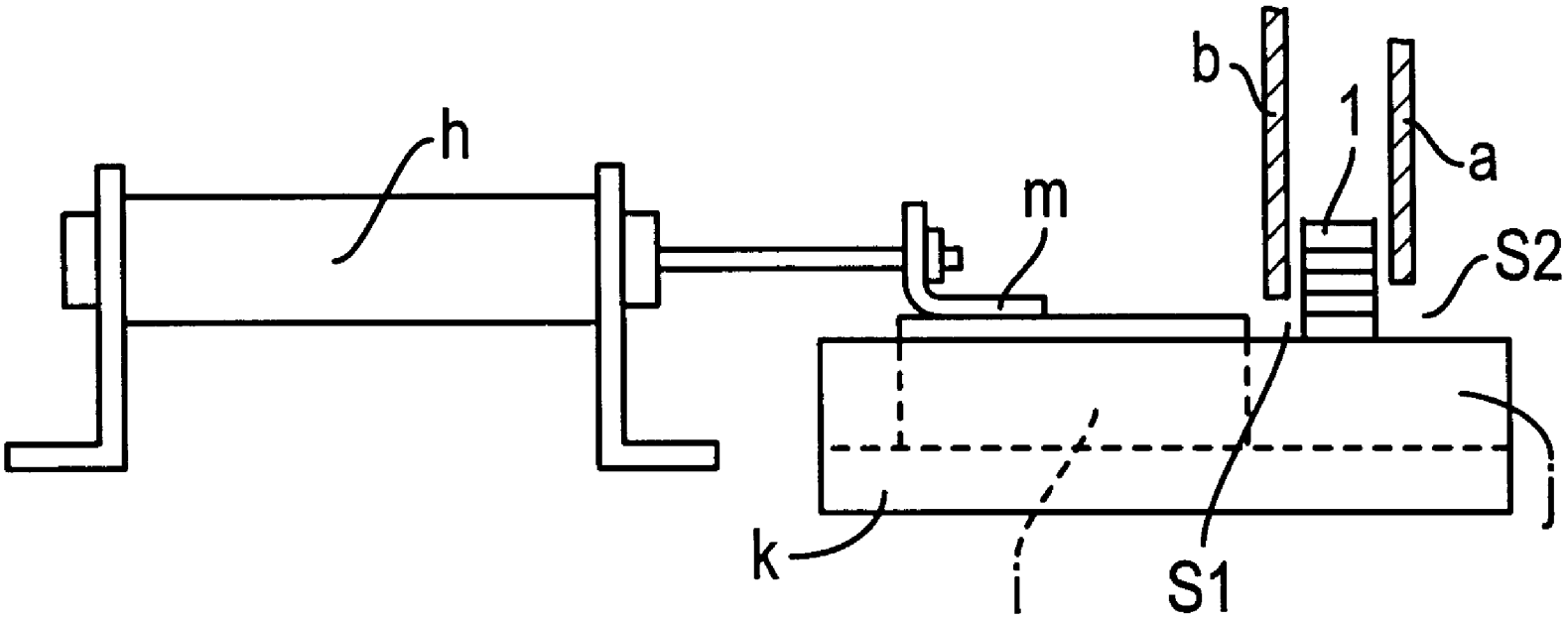
FIG. 2 is a side view depicting the relation of a knitting needle storing box, a seating and a slider, of knitting needle supplying means which is used for the invention.
Figure 3:
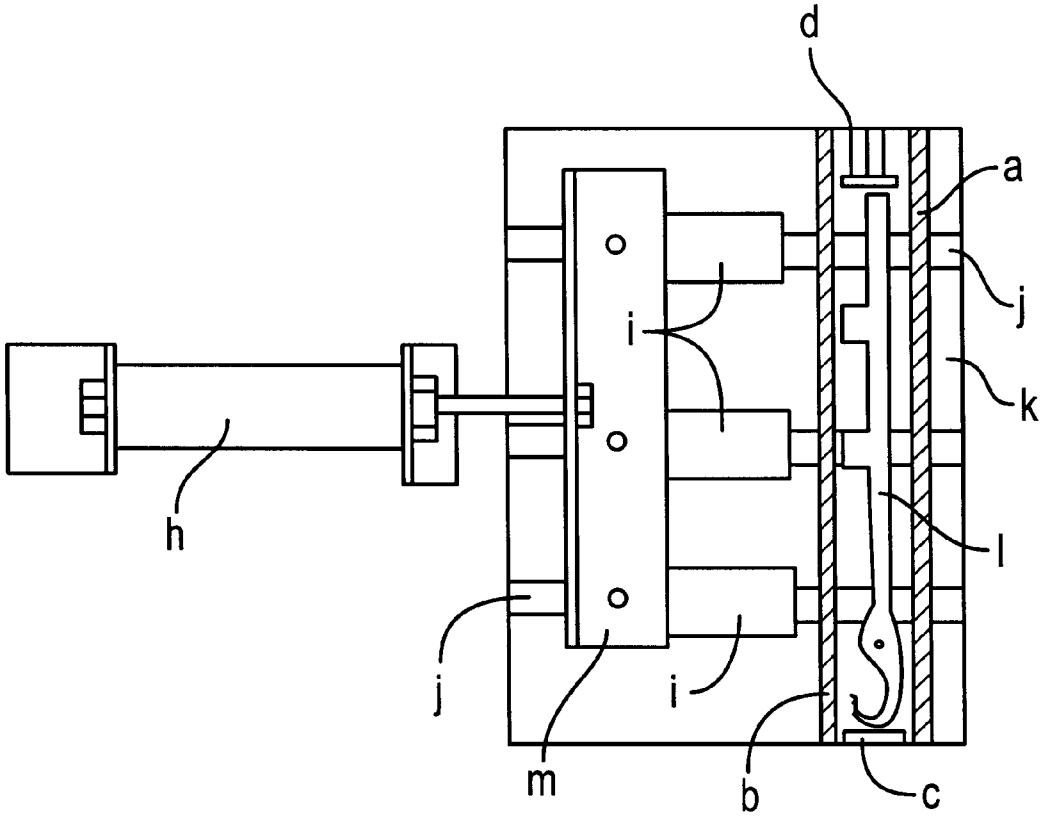
FIG. 3 is a plan view depicting the relation of the knitting needle storing box, the seating and the slider, of the knitting needle supplying means which is used for the invention.

FIG. 2 is a side view for explaining the relation among the knitting needle storing box (only back plates (*a*) and (*b*) are shown in FIG. 2), a seating (*k*), and a slider (*i*)). FIG. 3 is a plan view of the components shown in FIG. 2.

As shown in FIG. 2, the slider (*i*) slides and reciprocates on the surface of a guide groove (*j*) provided in the seating (*k*) and has the function of sequentially pushing one or plural knitting needles existing in the clearance between the opening part at the lower end of the knitting needle storing box and the seating along the radial direction of the knitting needle. In this case, the thickness of the slider which will be described hereinlater denotes the height of a protrusion of the slider from the surface of the seating. It is necessary to set the length of the slider to be longer than the stroke of the reciprocating motion of the slider.

As shown in FIG. 3, it is preferably to provide two or more sliders (*i*) so as to stably hold and push a knitting needle 1. It is also preferable to adjust the position of the front end of the slider (*i*) so that the front ends of the plurality of the sliders (*i*) can simultaneously push the knitting needle 1. The plurality of sliders (*i*) are coupled to a slider coupling member (*m*). A force to perform linear motion is transmitted to the sliders (*i*) by a slider driving unit (*h*) connected to the slider coupling member (*m*).

It is sufficient to properly set the clearance between the opening part at the lower end of the knitting needle storing box and the seating in accordance with the thickness of the knitting needle, the thickness of the slider, the number of knitting needles to be pushed, and the like.

Figure 4A:
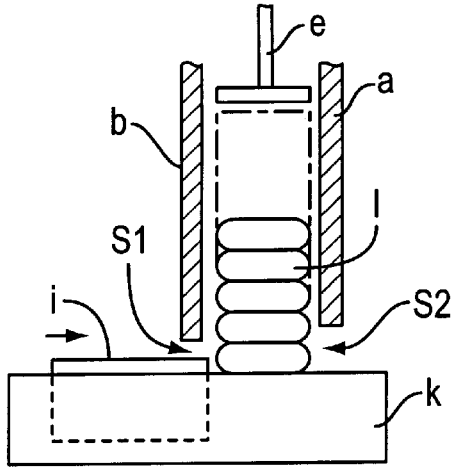
FIG. 4A–4C are side views depicting a mechanism of moving a knitting needle existing in a clearance below the knitting needle storing box to the outside of the knitting needle storing box via the slider.
Figure 4B:
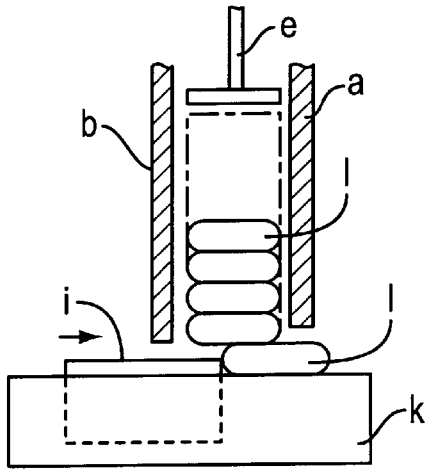
Figure 4C:
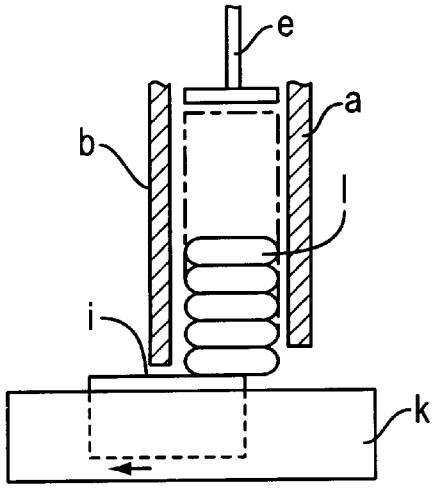

For example, in case of pushing one knitting needle, as shown in FIG. 4, the following relations (A) and (B) are satisfied among the thickness Dn of the knitting needle, the thickness Ds of the slider, and a clearance S1 between the opening end of the knitting needle storing box on the side the slider passes and the seating are satisfied.

(A) $Ds \leqq Dn$ (B) $Ds \leqq S1 < Ds + Dn$

Similarly, the following relations (C) is satisfied between the thickness Ds of the knitting needle and a clearance S2 between the opening part of the knitting needle storing box on the side the knitting needles are pushed and the seating.

(C) $Dn \leqq S2 < 2Dn$

Specifically, as shown in FIG. 4(*a*), the knitting needles 1 in the lower part of the knitting needle storing box are stacked on the seating (*k*) with a load by a pressuring mechanism (*e*) and are pushed by the slider (*i*) entering the clearance S1. Since the thickness Ds of the slider (*i*) is equal to or smaller than the thickness Dn of one knitting needle, only one knitting needle in the lowermost part of the knitting needle storing box can be pushed.

As shown in FIG. 4(*b*), since the clearance S2 is smaller than the thickness 2Dn of two knitting needles; the second knitting needle from the lowermost part cannot pass the clearance S2. In such a manner, a knitting needle of the number (one) which can pass the clearance S2 is sequentially taken from the knitting needle storing box and supplied by the reciprocating motion of the slider (*i*).

As shown in FIG. 4(*c*), after the knitting needle at the lowermost part is pushed out of the knitting needle storing box by the reciprocating motion of the slider (*i*), the remaining knitting needles 1 staked in the knitting needle storing box are on the slider (*i*), and this state continues until the slider (*i*) goes out of the knitting needle storing box from the clearance S1 (until the state of FIG. 4(*a*)). In this case, it is necessary to set the clearance S1 to be smaller than the total of the thickness Ds of the slider and the thickness Dn of the knitting needle so that the knitting needle on the slider (*i*) does not go out together with the slider (*i*) for the clearance S1.

When such knitting needle supplying means is employed, by repeating the operations of FIGS. 4(*a*) to 4(*c*), one or plural knitting needles can be taken from the knitting needle storing box and sequentially pushed along the knitting needle radial direction.

Figure 5:
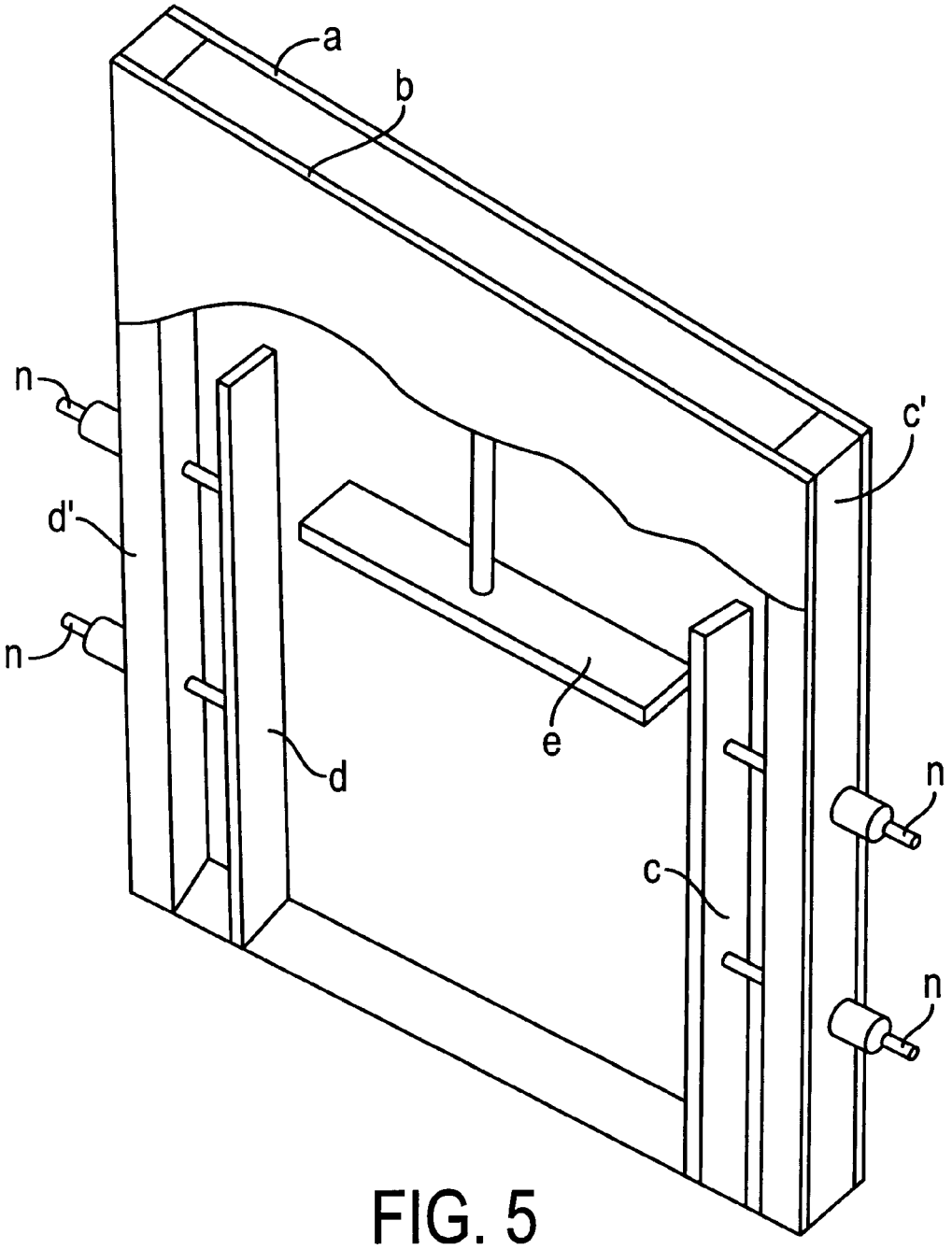
FIG. 5 is a perspective view depicting the knitting needle storing box of the knitting needle supplying means used for the invention.

FIG. 5 is a perspective view for explaining the knitting needle storing box of the knitting needle supplying means. In FIG. 5, back plates (*a*) and (*b*) are provided in facing positions at an interval which substantially corresponds to the radial width of the knitting needle 1 and the slides plates (*c*) and (*d*) are provided in facing positions on both sides of the back plates (*a*) and *b*) at an interval which substantially corresponds to the longitudinal length of the knitting needle 1. The knitting needle storing box having a space surrounded by the back plates (*a*) and (*b*) and the slide plates (*c*) and (*d*) is formed.

Further, the opening part from which the staked knitting needles can go out is formed at the lower end of the knitting needle storing box. Below the opening part, the seating (not shown in FIG. 5) is installed with a clearance from the opening part, and the slider which slides on the seating so as to freely enter the clearance is provided.

The knitting needle storing box in which the knitting needles 1 are stacked can also have a structure such that the side plates (*c*) and (*d*) are connected to threaded slide units (*n*) so that the interval between the side places (*c*) and (*d*) can be changed according to the length of the knitting needle and the slide units (*n*) are attached to side plate holding members *c'* and *d'*.

Pressuring mechanism (*e*) denotes the mechanism which is connected to an air cylinder or the like (not shown) and presses against the uppermost one of the knitting needles 1 stacked in the knitting needle storing box to correct a curve in the thickness direction of the knitting needle 1 and stably hold the knitting needles 1 in the knitting needle storing box. Preferably, the pressuring mechanism (*e*) has a detachable structure in consideration of the efficiency of the knitting needle replacement.

Although the material of the back plates (*a*) and (*b*) is not especially limited, it is preferable to use a transparent material so that the state of the knitting needles in the knitting needle storing box can be seen. For the lower end parts of the back plates (*a*) and (*b*), it is preferable to use a material which can withstand a motion load of the slider that pushes the lowermost one of the knitting needles 1 stacked in the knitting needle storing box. Different materials can be also used for the lower end part of the back plate and the upper part.

As the knitting needle stacking means which can be suitably used for the knitting needle arranging apparatus of the invention, a knitting needle stacking box including the following elements (*g*) to *i*) is shown as an example:

(*g*) an opening part which is provided in the upper part of the knitting needle stacking box and from which the pushed knitting needles are sequentially inserted along the radial direction of the knitting needle;

(*h*) a pair of holding guides provided in the upper part of the knitting needle stacking box, for sandwiching the knitting needle inserted from the opening part in a state where the knitting needle is inclined upward in the insertion direction of the knitting needle; and (*i*) a guide clearance adjusting mechanism for sequentially stacking and sandwiching the inclined knitting needles in the radial direction of the knitting needle between the pair of holding guides.

Figure 6:
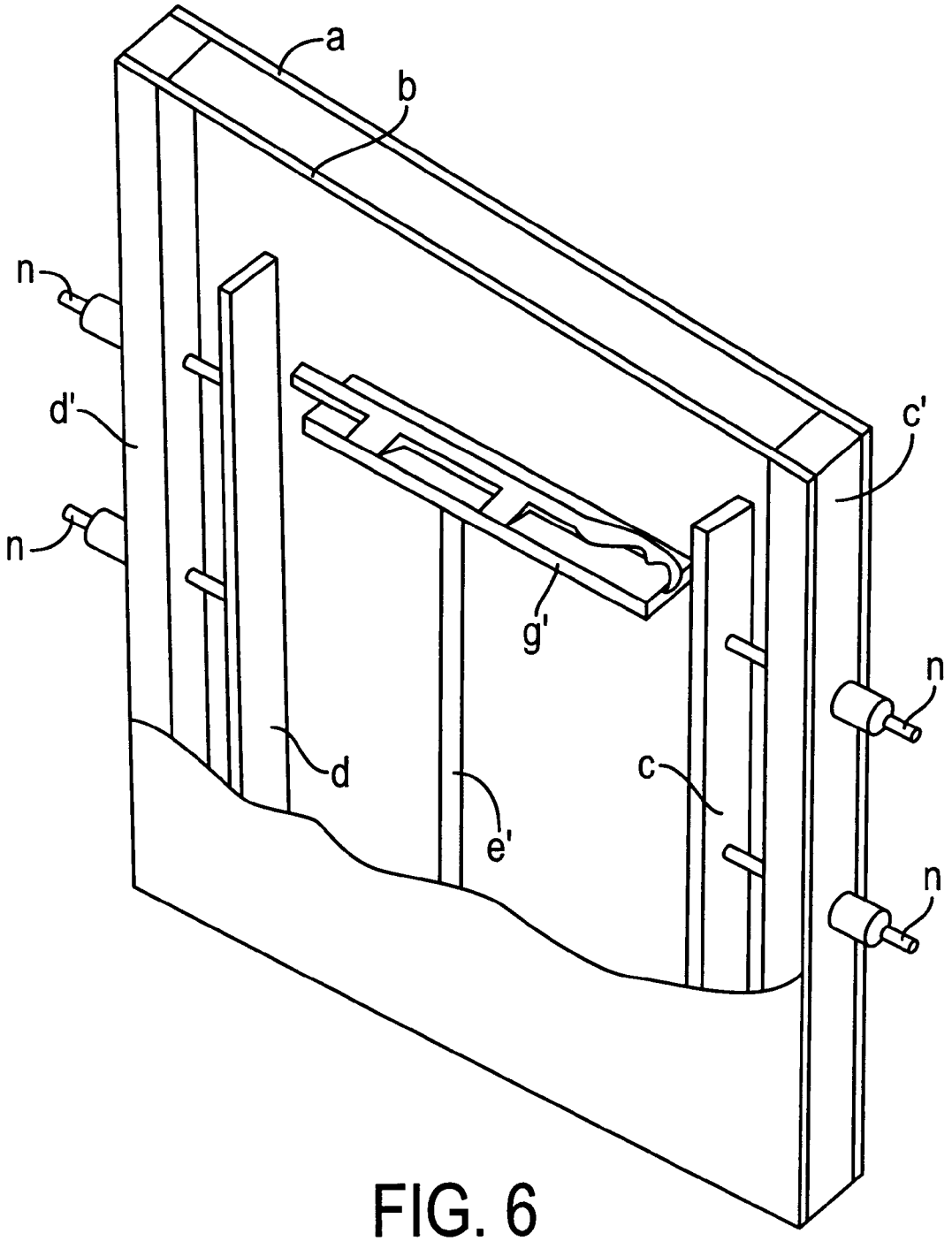
FIG. 6 is a perspective view depicting a knitting needle stacking box used for the invention.

FIG. 6 is a perspective view for explaining the knitting needle stacking box. In FIG. 6, the following point is similar to the knitting needle storing box of the knitting needle supplying means. The back plates (*a*) and (*b*) are provided in the facing positions at an interval substantially corresponding to the width of the knitting needle 1, the side plates (*c*) and (*d*) are provided in facing positions at an interval substantially corresponding to the length of the knitting needle 1, and the space surrounded by the back plates (*a*) and (*b*) and the side plates (*c*) and (*d*) for stacking the knitting needles is formed.

The knitting needle stacking box in which the knitting needles 1 are stacked can have a structure such that the side plates (*c*) and (*d*) are coupled to the threaded slide units (*n*) and the slide units *n*) are attached to the side plate holding members (*c'*) and (*d'*) so that the interval between the side plates (*c*) and (*d*) can be changed according to the longitudinal length of the knitting needle.

Although the material of the back plates (*a*) and (*b*) is not especially limited, it is preferable to use a transparent material so that the state of the knitting needles in the knitting needle stacking box can be seen. For the upper end parts of the back plates (*a*) and (*b*), it is preferable to use a material which can withstand a motion load of the slider when the knitting needle is pushed from the knitting needle supplying means. Different materials can be used for the lower end part and the upper part of the back plate.

(*e'*) denotes a guide clearance adjusting mechanism which is connected to an air cylinder or the like (not shown), stably holds the knitting needles 1 stacked and sandwiched by holding guides which will be described hereinlater in the knitting needle storing box, and makes the upper most knitting needle come into contact with the upper guide of the holding guides. Preferably, the guide clearance adjusting mechanism (*e'*) has a detachable structure in consideration of the efficiency of the work of taking the knitting needles.

Further, an opening part S3 (not shown in FIG. 6) for inserting the knitting needle pushed from the knitting needle supplying means along the direction of the width of the knitting needle is formed in the upper part of the knitting needle stacking box. A pair of holding guides (the upper guide is not shown in FIG. 6) for holding the knitting needle inserted from the opening part inclined upward in the knitting needle travel direction are provided in the upper part of the knitting needle stacking box.

Figure 7:
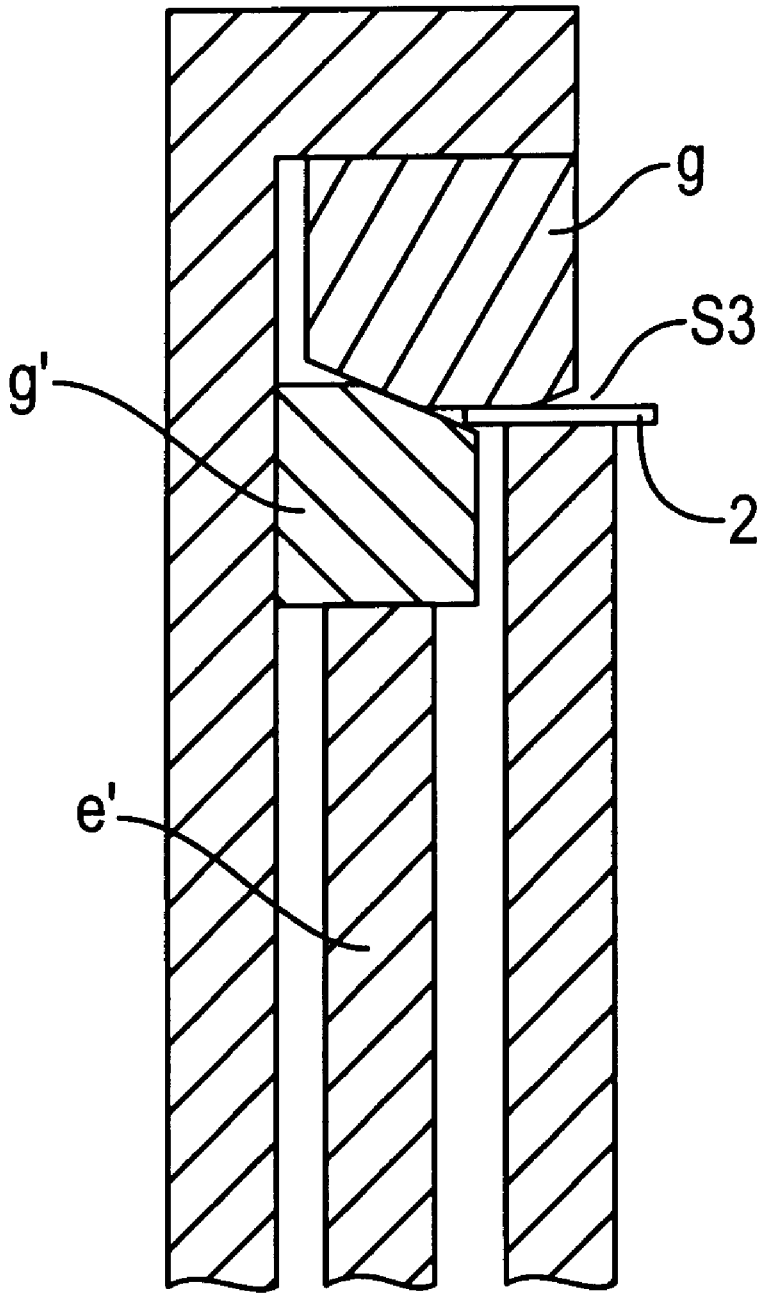
FIG. 7 is a side view depicting holding guides provided in the knitting needle stacking box used for the invention.

As shown in FIG. 7, the holding guides are constructed by an upper guide (*g*) and a lower guide (*g'*) and a taper is formed in the face which comes into contact with the knitting needle.

It is preferable to set the angle of inclination of the taper so that the knitting needle is inclined upward by 10 to 40° in the travel direction.

When the angle of inclination of the knitting needle is out of the range, the knitting needle cannot be inserted and there is a case that it is difficult to stack and hold the knitting needles.

That is, in FIG. 7, the knitting needle 2 inserted first from the opening part S3 is inserted between the upper guide (*g*) and the lower guide (*g'*) and is held inclined upward in the travel direction of the knitting needle along the taper formed in the face which comes into contact with the knitting needle of the upper and lower guides (*g*) and *g'*).

Figure 8:
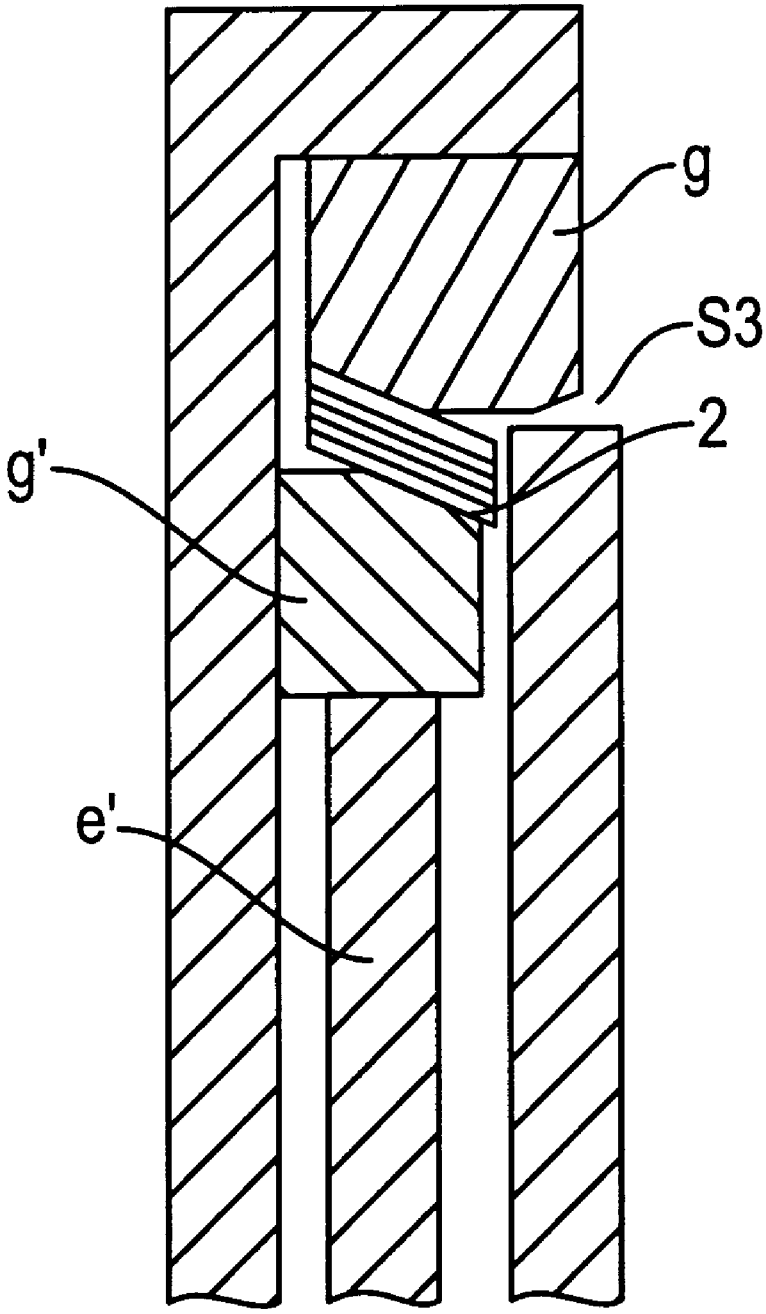
FIG. 8 is a side view depicting a mechanism of stacking knitting needles pushed from the knitting needle supplying means in the knitting needle stacking box via the holding guides.

Since the knitting needle is held in a state where it is pressed from below by the guide clearance adjusting mechanism (*e'*), the knitting needle which is inserted next can be held in a state where it is inclined upward in the travel direction of the knitting needle in a manner similar to the knitting needle which has been inserted first. By repeating the operation, the knitting needles can be staked and held in the knitting needle stacking box as shown in FIG. 8.

INDUSTRIAL APPLICABILITY

A knitting needle arranging apparatus of the invention comprises knitting needle supplying means for supplying knitting needles and knitting needle stacking means for stacking and holding the supplied knitting needles, and can stack up the knitting needles in the inserting order. Consequently, the apparatus can be suitably used for a knitting needle inserting method of simply successively inserting stacked knitting needles to grooves. A part or all of the knitting needle inserting work of a knitting machine which has been performed manually can be automated.

What is claimed is:

1. A knitting needle arranging apparatus comprising:

(a) a first and second knitting needle supplying means for sequentially pushing at least one knitting needle in a first direction, said at least one knitting needle having a radial thickness and a longitudinal length;

(b) knitting needle stacking means for sequentially stacking and holding the at least one knitting needle in the radial direction of the knitting needle pushed by the first and second knitting needle supply means; and (c) means for moving the knitting needle stacking means from the first one of the knitting needle supplying means to the second knitting needle supplying means.

2. A knitting needle arranging apparatus according to claim 1, wherein the first and second knitting needle supplying means each comprises:

(d) a knitting needle storing box for stacking and storing a plurality of knitting needles in the radial direction of the knitting needle from a lower end of said storage box to an upper end of said storage box, said storage box having an opening part from which each of the stacked knitting needles can pass at the lower end;

(e) a seating installed below the opening part of the knitting needle storing box so as to have a clearance corresponding to the total radial thickness of one or plural knitting needles with the opening part; and (f) a slider which slides on the seating so as to freely enter the clearance, for sequentially pushing the at least one needle existing in the clearance along the radial direction of the knitting needle.

3. A knitting needle arranging apparatus according to claim 1, wherein the knitting needle stacking means is a knitting needle stacking box comprising:

(g) an opening part which is provided in an upper part of the knitting needle stacking box and from which the at least one pushed knitting needle is sequentially inserted along the radial direction of the knitting needle;

(h) a pair of holding guides provided in the upper part of the knitting needle stacking box, for sandwiching a first knitting needle inserted from the opening part in a state where the first knitting needle is inclined upward in the insertion direction of the knitting needle; and (i) a guide clearance adjusting mechanism for sequentially stacking and sandwiching each inclined knitting needle in the radial direction of the knitting needle between the pair of holding guides.

4. A knitting needle arranging apparatus according to claim 2, wherein the knitting needle stacking means is a knitting needle stacking box comprising:

(j) an opening part which is provided in an upper part of the knitting needle stacking box and from which the pushed knitting needles are sequentially inserted along the radial width direction of the knitting needle;

(k) a pair of holding guides provided in the upper part of the knitting needle stacking box, for sandwiching a first knitting needle inserted from the opening part in a state where the first knitting needle is inclined upward in the insertion direction of the knitting needle; and (l) a guide clearance adjusting mechanism for sequentially stacking and sandwiching the inclined knitting needle in the radial direction of the knitting needle between the pair of holding guides.

5. A knitting needle arranging apparatus according to claim 1, wherein the stacking means stacks and holds a first knitting needle having a first radial dimension and a second needle having a second radial dimension.

6. A knitting needle arranging apparatus according to claim 1, wherein the stacking means stacks and holds a first knitting needle having a first longitudinal length and a second knitting needle having a second longitudinal length.

7. A knitting needle arranging apparatus according to claim 1, wherein the stacking means is adapted to stack and hold at least two kinds of needles.

8. A knitting needle stacking box comprising:

an opening part in an upper part of the knitting needle stacking box from which knitting needles are sequentially inserted, said knitting needles having a radial width and a longitudinal length;

a pair of holding guides in the upper part of the knitting needle stacking box for sandwiching a first knitting needle from the opening part, said knitting needle inclined along the longitudinal direction; and a guide clearance adjusting mechanism for sequentially stacking and sandwiching the inclined knitting needle along the radial direction between the pair of holding guides.

9. A knitting needle arranging apparatus comprising:

(a) a first and second knitting needle supplies that sequentially pushes at least one knitting needle in a first direction, said at least one knitting needle having a radial thickness and a longitudinal length;

(b) a knitting needle stacker that sequentially stacks and holds the at least one knitting needle in the radial direction of the knitting needle pushed by the first and second knitting needle supply; and (c) a mover that moves the knitting needle stacker from the first knitting needle supply to the second knitting needle supply.

10. A knitting needle arranging apparatus according to claim 9, wherein the first and second knitting needle supplies each comprise:

(d) a knitting needle storing box that stacks and stores a plurality of knitting needles in the radial direction of the knitting needle from a lower end of said storage box to an upper end of said storage box, said storage box having an opening part from which each of the stacked knitting needles can pass at the lower end;

(e) a seating installed below the opening part of the knitting needle storing box so as to have a clearance corresponding to the total radial thickness of one or plural knitting needles with the opening part; and (f) a slider which slides on the seating so as to freely enter the clearance, that sequentially pushes the at least one needle existing in the clearance along the radial direction of the knitting needle.

11. A knitting needle arranging apparatus according to claim 9, wherein the knitting needle stacker is a knitting needle stacking box comprising:

(g) an opening part which is provided in an upper part of the knitting needle stacking box and from which the at least one pushed knitting needle is sequentially inserted along the radial direction of the knitting needle;

(h) a pair of holding guides provided in the upper part of the knitting needle stacking box, that sandwiches a first knitting needle inserted from the opening part in a state where the first knitting needle is inclined upward in the insertion direction of the knitting needle; and (i) a guide clearance adjusting mechanism that sequentially stacks and sandwiches each inclined knitting needle in the radial direction of the knitting needle between the pair of holding guides.

12. A knitting needle arranging apparatus according to claim 10, wherein the knitting needle stacker is a knitting needle stacking box comprising:

(j) an opening part which is provided in an upper part of the knitting needle stacking box and from which the pushed knitting needles are sequentially inserted along the radial width direction of the knitting needle;

(k) a pair of holding guides provided in the upper part of the knitting needle stacking box, that sandwiches a first knitting needle inserted from the opening part in a state where the first knitting needle is inclined upward in the insertion direction of the knitting needle; and (l) a guide clearance adjuster that sequentially stacks and sandwiches the inclined knitting needle in the radial direction of the knitting needle between the pair of holding guides.

13. A knitting needle arranging apparatus according to claim 9, wherein the stacker stacks and holds a first knitting needle having a first radial dimension and a second needle having a second radial dimension.

14. A knitting needle arranging apparatus according to claim 9, wherein the stacker stacks and holds a first knitting needle having a first longitudinal length and a second knitting needle having a second longitudinal length.

15. A knitting needle arranging apparatus according to claim 9, wherein the stacker is adapted to stack and hold at least two kinds of needles.

* * * * *